US006840695B2

(12) United States Patent
Horn

(10) Patent No.: US 6,840,695 B2
(45) Date of Patent: Jan. 11, 2005

(54) RING-BINDER MECHANISM

(75) Inventor: Hans Johann Horn, Bern (CH)

(73) Assignee: Esselte Leitz GmbH & Co KG (DE)

( * ) Notice: Subject to any disclaimer, the term of this patent is extended or adjusted under 35 U.S.C. 154(b) by 256 days.

(21) Appl. No.: 10/019,422

(22) PCT Filed: Apr. 11, 2001

(86) PCT No.: PCT/EP01/04150

§ 371 (c)(1),
(2), (4) Date: Dec. 20, 2001

(87) PCT Pub. No.: WO01/81099

PCT Pub. Date: Nov. 1, 2001

(65) Prior Publication Data

US 2002/0122687 A1 Sep. 5, 2002

(30) Foreign Application Priority Data

Apr. 25, 2000 (DE) ..... 100 20 200

(51) Int. Cl.[7] ..... B42F 3/04
(52) U.S. Cl. ..... 402/31
(58) Field of Search ..... 402/21, 20, 31, 402/42, 43, 36, 37, 38, 39, 41

(56) References Cited

U.S. PATENT DOCUMENTS

| | | | | |
|---|---|---|---|---|
| 974,831 A | | 11/1910 | Scherzinger | |
| 1,163,179 A | | 12/1915 | Schade | |
| 1,787,957 A | | 1/1931 | Schade | |
| 1,996,463 A | | 4/1935 | Dawson et al. | 129/24 |
| 3,993,374 A | | 11/1976 | Schudy et al. | |
| 4,130,368 A | | 12/1978 | Jacoby et al. | |
| 4,566,817 A | | 1/1986 | Barrett, Jr. | |
| 5,816,729 A | * | 10/1998 | Whaley | 402/31 |
| 6,270,279 B1 | * | 8/2001 | Whaley | 402/38 |

FOREIGN PATENT DOCUMENTS

GB 2 292 343 A 9/1995

* cited by examiner

*Primary Examiner*—Jacob K. Ackun, Jr.
(74) *Attorney, Agent, or Firm*—Pendorf & Cutliff

(57) ABSTRACT

The invention concerns a ring binder mechanism for receiving loose, holed written materials. The ring binder mechanism includes a housing (10) having spring-elastic housing flanks (28) which can be urged open. Two carrier rails (20) are provided in the housing, which are pivotable along their facing longitudinal edges in the manner of a knee-joint against the spring effect of the housing flanks (28). At least two half-rings (16) are provided longitudinally spaced apart and rigidly connected with each of the carrier rails (20), and which pairwise form a ring (14). Further, at least one blocking element (32) is provided slideable or moveable via operating element (18) essentially parallel to the linkage axis (22) relative to the housing (10) and to the carrier rails (20) which, in the closed position, protrudes into a free space (34) formed between the carrier rails (20) and the housing wall (13) with blockage of the pivot movement of the carrier rails (20) and, in the open position, permits the pivot movement of the carrier rails (20). According to the invention at least one blocking element (32) is pre-tensioned in the direction of the closed position under the influence of a closing spring (36).

45 Claims, 12 Drawing Sheets

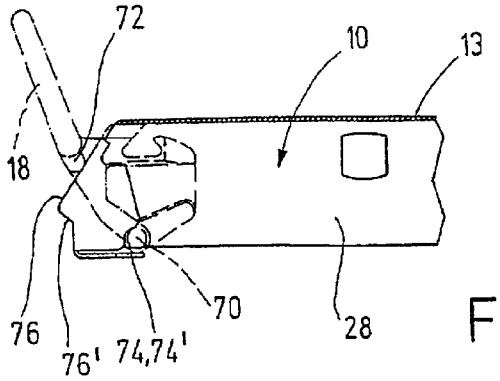
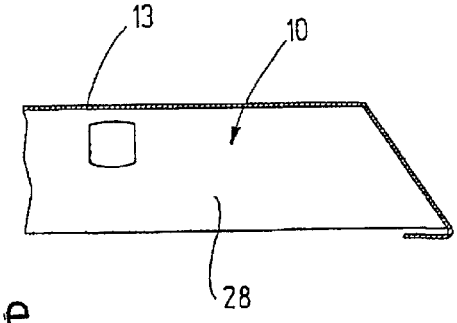
Fig.4e
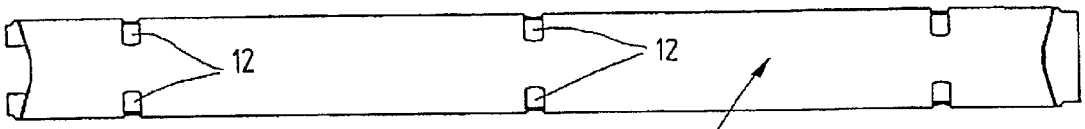
Fig.4c 16
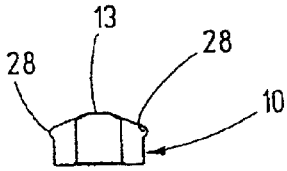
Fig.4d
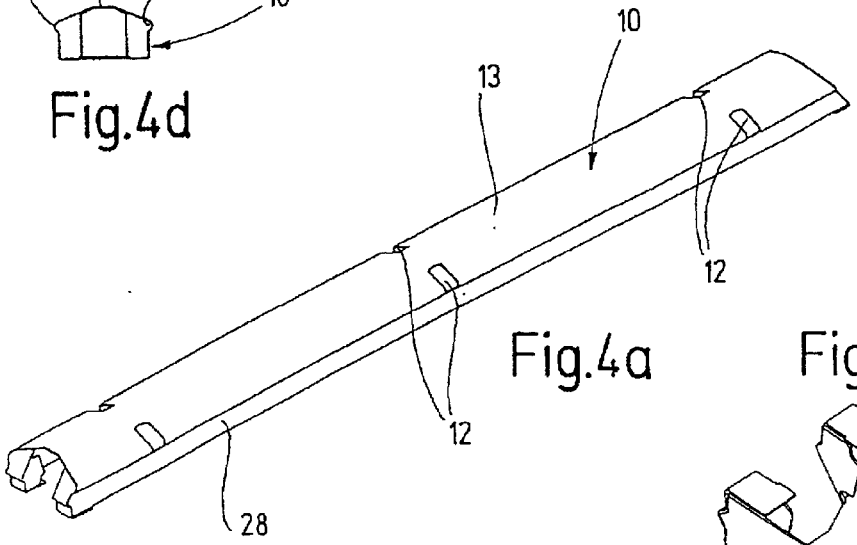
Fig.4a
Fig.4b
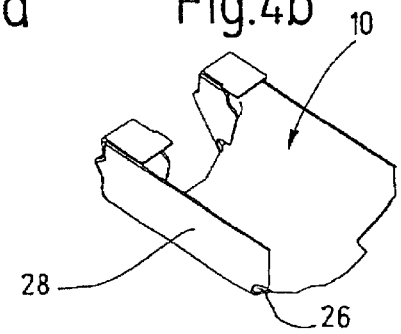

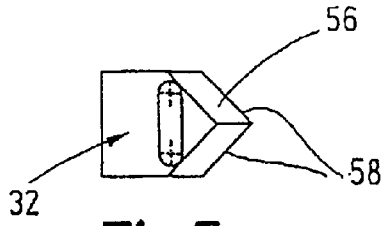
Fig.7c
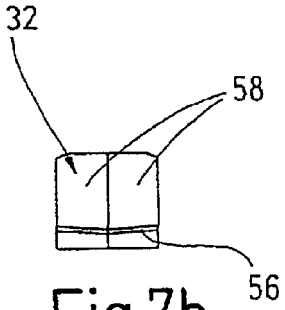
Fig.7b
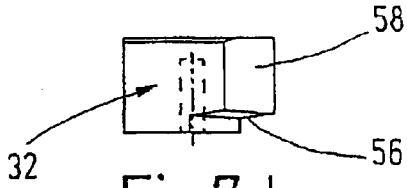
Fig.7d
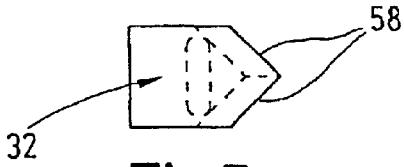
Fig.7e
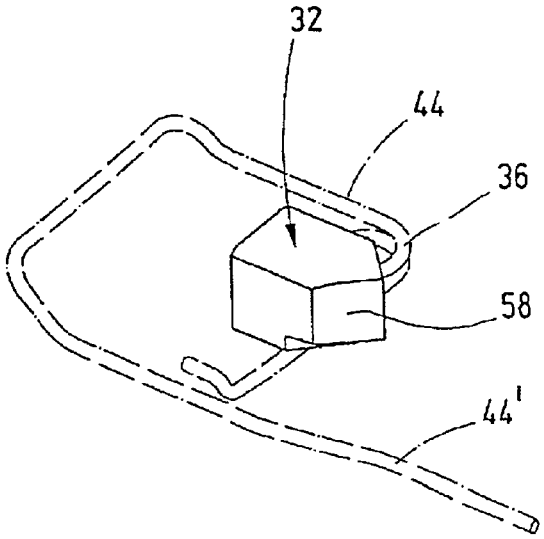
Fig.7a
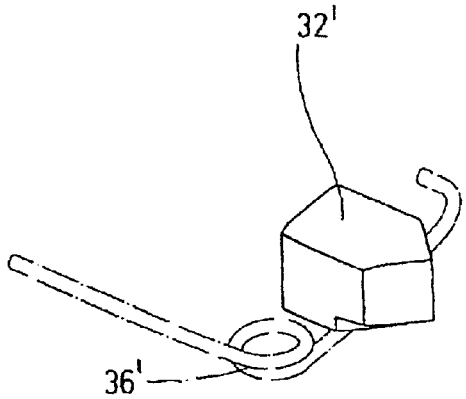

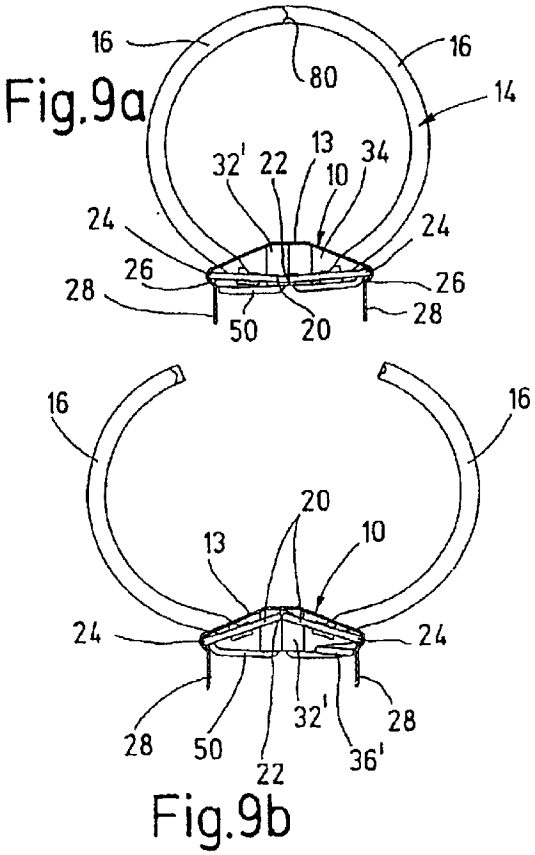
Fig.9a
Fig.9b
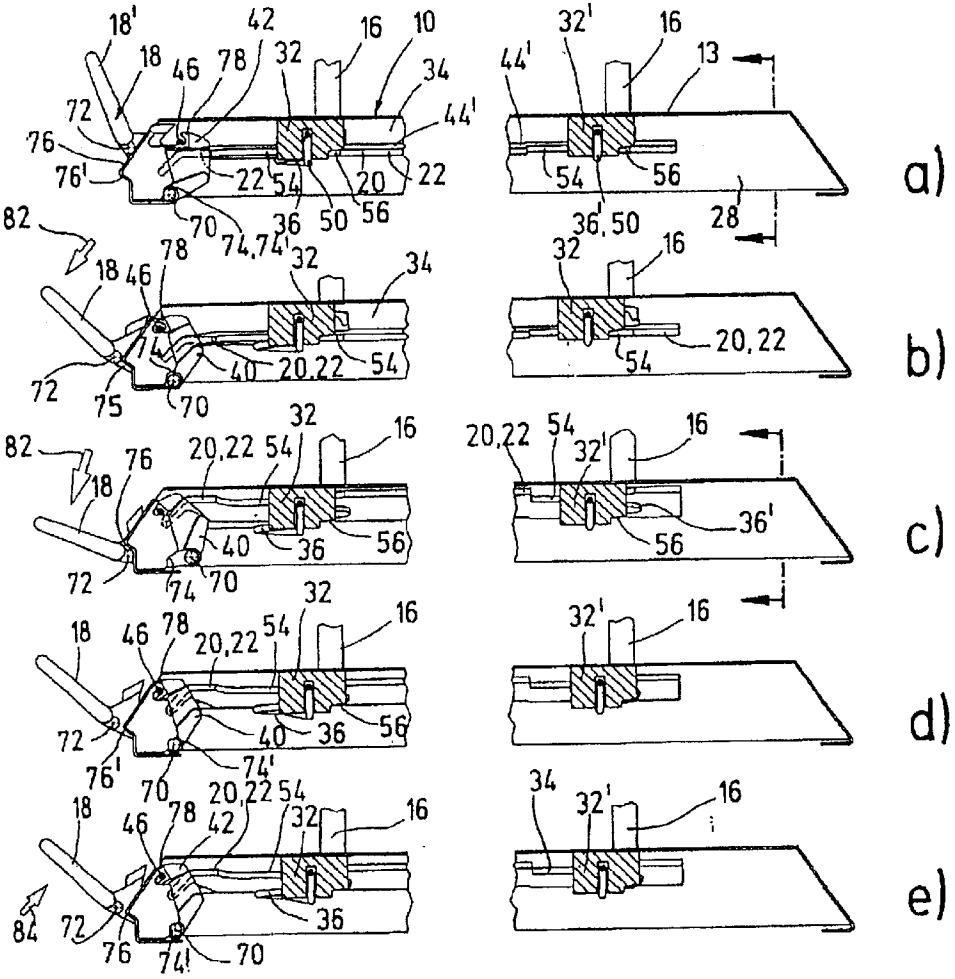
Fig.8
a)
b)
c)
d)
e)

18
36
48
50
102
104
108
106
100
112
114
116
118
120
122
124
34
32
38,110
20,22
22,20
40
42

RING-BINDER MECHANISM

BACKGROUND OF THE INVENTION

1. Field of the Invention

The invention concerns a ring binder mechanism with a housing having a C-shaped or U-shaped cross-section, with elastic mounting flanks which can be bent open for receiving two carrier rails, which on their facing longitudinal edges lie against each other with formation of a linkage axis, and which with their away-facing longitudinal edges engage in mounting grooves of the mounting flanks, and with at least two half-rings rigidly connected with the carrier rail in a defined longitudinal separation from each other, extending through openings in a housing wall and forming themselves pairwise into a ring, wherein the carrier rails are limitedly pivotable relative to each other about the longitudinal pivot axis between an open position and a closed position, while overcoming the spring force produced by the bending open of the mounting shanks, and while taking along the half-rings, and wherein at least one blocking element is provided displaceable or moveable relative to the housing essentially parallel to longitudinal pivot axis and to the carrier rails via an operating element, which blocking element when in the closed position engages in a free space formed between the carrier rails and the housing wall thereby blocking the pivot movement, and when in the open position releases the linkage axis to pivot.

2. Description of the Related Art

In ring binder mechanisms it is known to secure half-rings arranged in a row upon carrier rails, which are surrounded by a housing of a spring elastic material. The carrier rails are so introduced into the housing that they can assume two rest positions, one open and one closed. The housing functions as a spring element, which retains the half-rings in their open position or in their closed position. In the area of the inner longitudinal edges of the carrier rails, there are take-along or engaging means, which ensure that the two carrier rails along these longitudinal edges are always lying flush against each other. The carrier rails thereby have the function of a knee-lever held in spring tension by the outer edge. With these known ring notebook mechanisms the opening and closing of the rings occurs directly via the half-rings. In order to attain sufficient pretension or pull forces, it is necessary to have a relatively large spring force in the area of the housing. The necessary operating forces must be commensurately large. The greater these forces are, so much the greater is also the danger of injury during closure at the abutment surfaces between the ring-halves. On the other hand, since the closure forces are exclusively introduced elastically, it frequently occurs that the rings in response to a particular stress, for example, during falling onto the floor, open from themselves, so that the therein situated writing materials can be released.

In order to avoid this disadvantage, it has already been proposed to secure the rings in their closed position using a sliding element (U.S. Pat. No. 4,566,817). The sliding element exhibits blocking elements slideable parallel to the linkage axis relative to the housing and to the carrier rails, which engage in the locking position into a free space formed between the carrier rails and the housing wall to block the pivot movement of the carrier rails, and in the open position unblock the pivot path. The sliding element is moved between the open position and the locked position by hand. Also possible are intermediate positions without function. For operating the sliding element the binder must be laid down somewhere or held. Two hands are necessary to do this. From the open position this ring binder mechanism cannot be closed or operated via the rings.

SUMMARY OF THE INVENTION

Beginning therewith it is the task of the present invention to develop a ring binder mechanism, which during the closing process automatically becomes blocked against an undesired opening, and which can be operated simply and with low energy expenditure even with one hand.

The inventive solution is based upon the idea, that a blocking element automatically enters into its locking or blocking position during the course of the closing process. In order to make this possible, it is proposed in accordance with the invention, that at least one blocking element is pre-tensioned under the influence of a blocking spring in the direction of the locking position.

It is herein particularly advantageous, when the at least one blocking element

- is slideable or moveable in the open direction via the operating mechanism against the force of the blocking springs and is thereby unlockable,
- lies in the open position under the influence of the blocking spring against an opening detent,
- is releaseable out of the opening detent into the closing direction via the operating element against the force of the closing spring,
- is automatically lockable in the locking direction under the influence of the pre-tensioned blocking spring,
- is slideable or moveable in the locking direction directly by operation of the half-rings or indirectly via the carrier rails against the force of the blocking spring and thereby is releaseable from the opening detent.

A further preferred embodiment of the invention envisions, that the operating element

- is in the form of an operating lever pivotable relative to the housing,
- includes an opening arm or cantilever which abuts against the carrier rails when urged in the opening direction, and pivots these from the closed into the open position while overcoming the spring force produced by the mounting flanks,
- includes a pivotable closing arm or cantilever which abuts against the carrier rails when urged in the closing direction, and pivots these from the open into the closed position while overcoming the spring force produced by the mounting flanks,
- includes in the opening and/or closed direction at least two operating positions effective in different angular positions for a consequential operation of the carrier rails and the at least one blocking element.

According to a first embodiment of the invention, which is particularly suitable for a binder notebook mechanism with two rings, it is proposed that the blocking element is provided on a lever arm rigidly connected with the operating lever, and that the operating lever is limitedly slideable or moveable relative to the housing and to the carrier rails in the slide direction of the blocking element. The blocking spring is herein preferably tensioned between a housing fixed and an operating lever fixed abutment and preferably formed as an operating lever spring. It is of particular advantage when the operating lever exhibits a control curve guided on a control edge of the housing, via which the operating lever with its blocking element during pivoting is slideable or moveable against the force of the blocking spring from a locking position in the direction of the open position.

The opening process of the rings is facilitated when the operating lever is rigidly connected with an opening arm or cantilever acting in the opening direction against the carrier rails. The opening arm or cantilever is thereby preferably provided at such a distance or separation from the blocking element, that in the blocking position of the operating lever the blocking element is introducible in the free space between carrier rails and housing wall under the effect of the blocking spring, and in the open position abuts under the influence of the blocking spring against a housing-fixed detent. The blocking element can simultaneously be adapted to perform as a closing arm acting in the closing direction against the carrier rails.

It is further of advantage, when the operating lever includes at least one axis or pivot pin element, which when in the open position lies against a housing fixed mounting surface of the operating lever under the influence of the blocking spring, and forms a pivot axis for the blocking element during the unblocking and blocking movement. In the blocking position of the operating lever the pivot pin element is lifted from the housing fixed mounting surface.

The control curve can be provided on a control arm which extends through a wall opening of the housing and a through hole provided in the abutment area between the carrier rails, while the control edge can be formed by a preferably curved boundary edge of the wall opening.

It is of particular advantage, when the blocking element is provided on a lever arm which passes through a wall opening in the housing, while the housing fixed detent is formed by a preferably curved boundary edge of the wall opening. In the locked position the blocking element preferably lies against a housing-fixed abutment under the influence of the blocking spring, which abutment can be wedge-shaped in the blocking direction and can be formed as arch protruding from the housing wall into the free space.

It is of particular advantage when the operating lever is provided and guided on the housing in the intermediate area between two rings and exhibits an operating arm extending through the opening or loop of one of the rings. When the operating arm is directed towards the side opposite the blocking element carrying lever arm, the mechanism is opened by pressing down the operating arm and closed by lifting the operating arm. When, in contrast, the operating arm is directed towards the same side as the blocking element carrying lever arm, the mechanism blocks by pressing down of the operating arm and is released by lifting. During the closing movement of the operating arm the blocking element is automatically slid, in the last phase, into the blocking position under the influence of the blocking spring. There, the blocking element ensures that the rings cannot be opened by pulling apart of the half-rings. During the course of opening of the operating arm, the blocking element reaches the detent in the last phase under the influence of the blocking spring. The detent connection is thereby so designed, that it can be released by manipulating the operating arm or the half-rings in the closing direction.

According to a further advantageous embodiment of the invention the at least one blocking element is rigidly provided on a control rod, preferably formed as a pull-rod, wherein the push rod is limitedly slideable or moveable relative to the housing via the operating lever under the influence of the blocking spring in the longitudinal direction of the carrier rails. The blocking spring is thereby preferably formed as a pressure spring. In accordance therewith the operating lever is provided on one end of the push rod, while the blocking spring is tensioned between the other end of the push rod and a housing fixed abutment, so that the operating lever in the opening direction pulls on the push rod against the force of the blocking spring.

When, in accordance with the above described embodiment, multiple blocking elements are rigidly connected to a push rod, a tolerance problem occurs, which requires a high level of care in the production and assembly of the ring binder mechanism.

In order to avoid tolerance problems of this type, it is proposed in accordance with a preferred embodiment of in the invention, that the at least one blocking element is connected with the operating lever via a tension member and a blocking spring integrated in the tension member. Preferably each blocking element is provided with its own tension member, preferably formed as a piece of wire, wherein at least two of the tension members could be connected with each other as a single piece via a connecting bridge section. Therewith it is possible to provide each blocking element with its own blocking spring.

Preferably the blocking spring is formed as a lever spring or spring clip integrated in the tension member, of which one leg is connected with the operating lever via the tension member and the other leg is supported against a housing fixed or carrier rail fixed mounting point and is linked in separation from the abutment point on the associated blocking element. It is of particular advantage when the at least one blocking element is formed as a slide element guided in a guide through-hole or slot between the two carrier rails, which exhibits, in the blocking direction in the free space, a wedge-shaped blocking surface. The wedge surface serves above all for tolerance adjustment. The wedge angle is so selected, that in the closed or blocking position a self-locking or automatic-jamming occurs. Preferably the sliding element exhibits an arrow-shaped surface in the direction of the locking direction, while the guide opening on its bordering edge facing the arrow-shaped sliding element surface exhibits a thereto complimentary arrow shape.

BRIEF DESCRIPTION OF THE DRAWING

In the following the invention will be described in greater detail on the basis of the embodiment shown in the figures. There is shown FIGS. 1*a–c* a top view, a longitudinal section and an end view of a ring binder mechanism with three rings in closed condition;

FIG. 4*a* a perspective representation of the spring-elastic housing of the ring binder mechanism according to FIGS. 1*a–c;*

FIG. 4*b* a bottom segment view of the housing in perspective representation;

FIGS. 4*c* and *d* a top view and a side view of the housing;

FIG. 4*e* a longitudinal section through the spring elastic housing in enlarged break away representation;

FIG. 7*a* a perspective representation of the blocking element;

FIGS. 7*b–e* various side views of the blocking element according to FIG. 7*a;*

FIGS. 8*a–e* a section through the ring binder mechanism in closed position, in a first and second opening phase, in opening position and in a closing phase;

FIGS. 9*a* and *b* a cross section through the binder ring mechanism in closed position and in open position;

DETAILED DESCRIPTION OF THE INVENTION

Figure 3C:
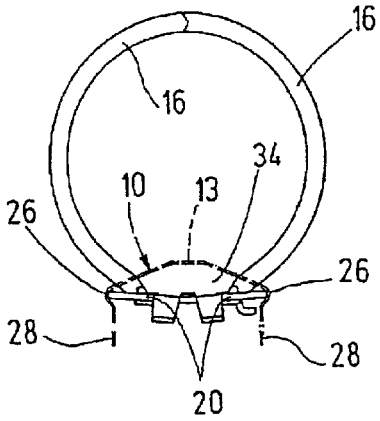
FIGS. 3*c* and *d* respectively one end view of the carrier rail-ring assembly in closed position and in open position.
Figure 3D:
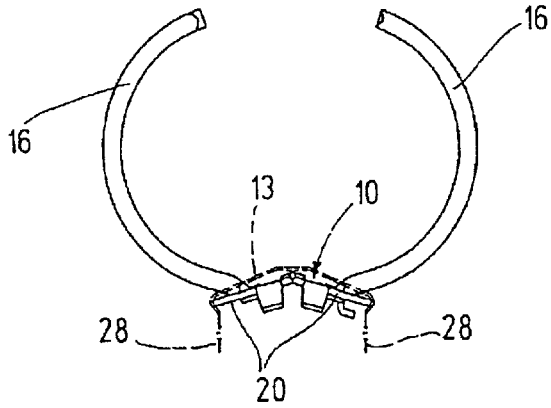
FIGS. 3*a* and *b* two different sections from the carrier rail-ring assembly according to FIGS. 2*a–c* in perspective representation.
Figure 3B:
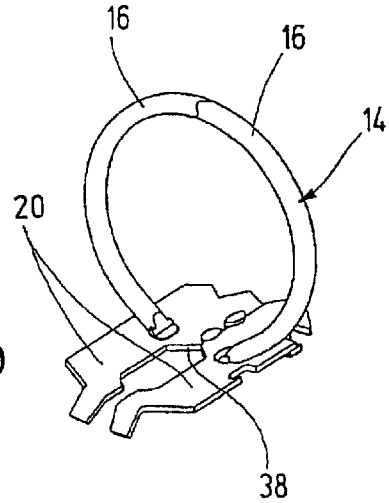
Figure 3A:
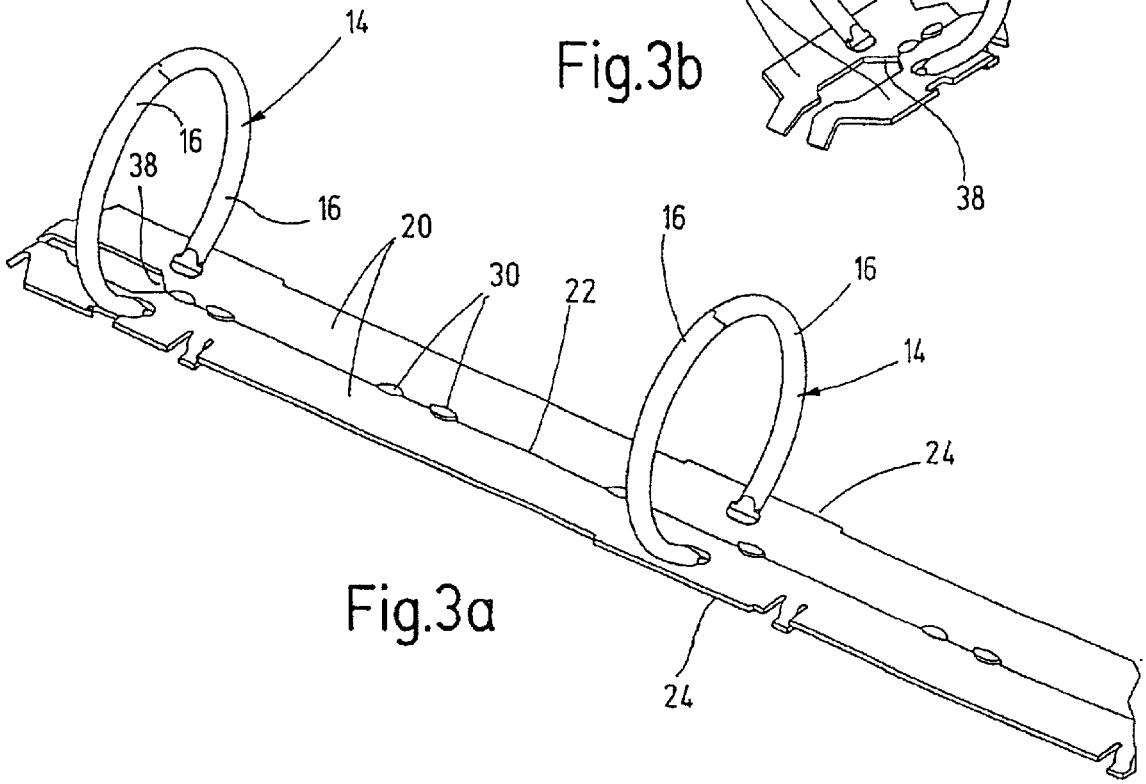
Figure 5B:
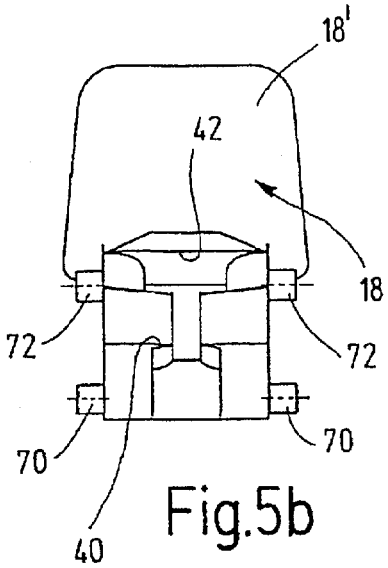
FIGS. 5*b–e* various views of the operating lever according to FIG. 5*a;*
Figure 5C:
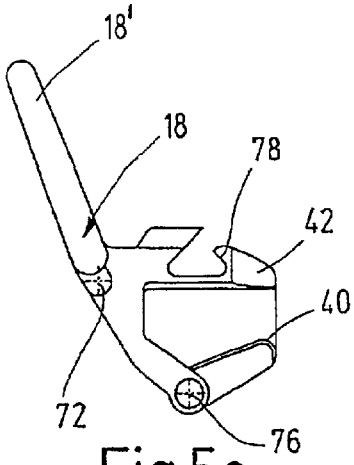
Figure 5D:
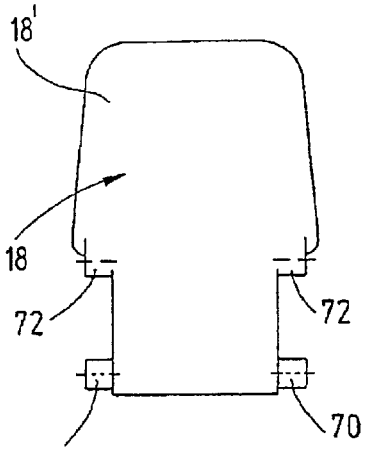
Figure 5E:
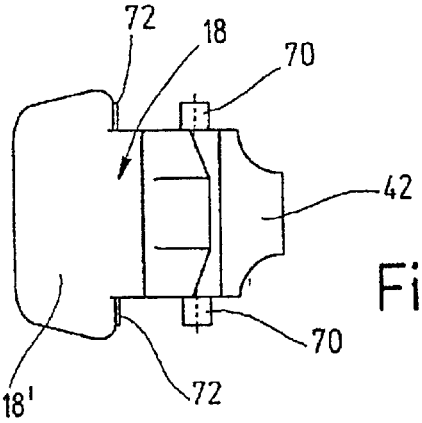
Figure 5A:
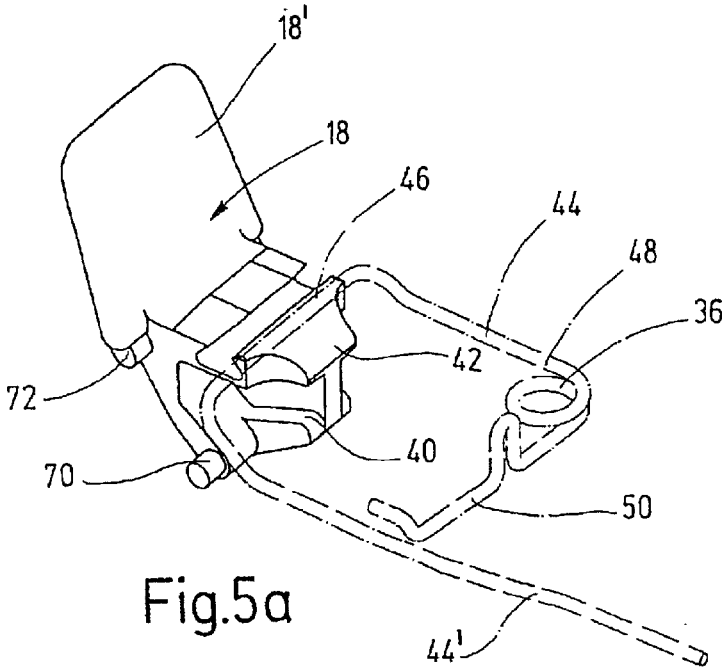
FIG. 5*a* a perspective representation of the operating lever of the ring binder mechanism according to FIGS. 1*a–c;*
Figure 6A:
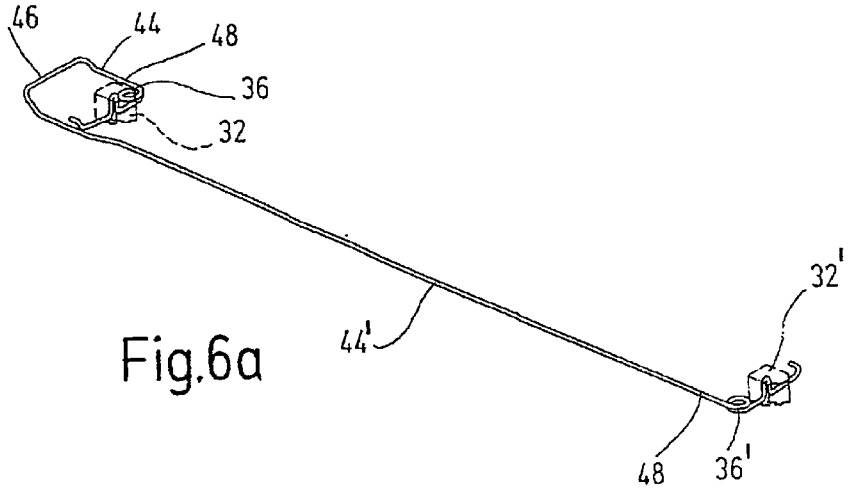
FIG. 6*a* a perspective representation of the tension member for the blocking elements of the ring binder mechanism according to FIGS. 1*a–c;*
Figure 6B:
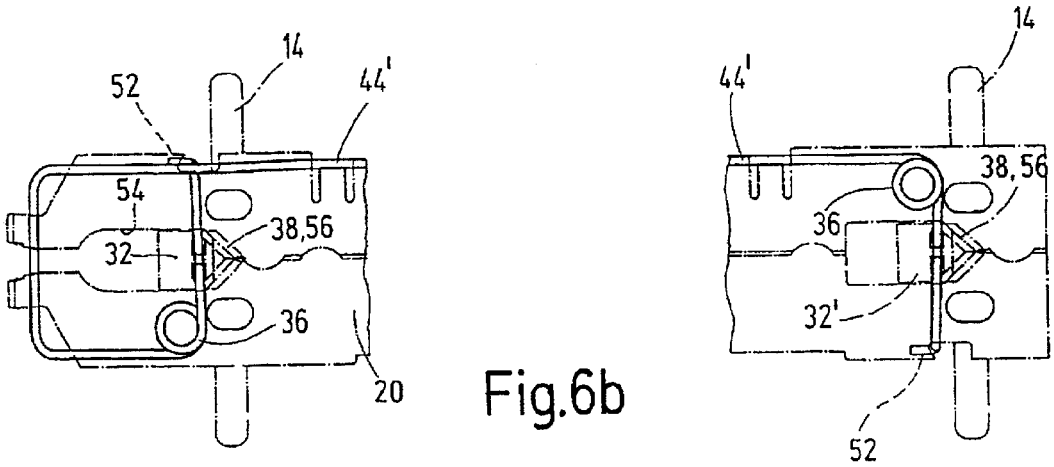
FIG. 6*b* a top view of the tension member in broken, enlarged representation.
Figure 6C:
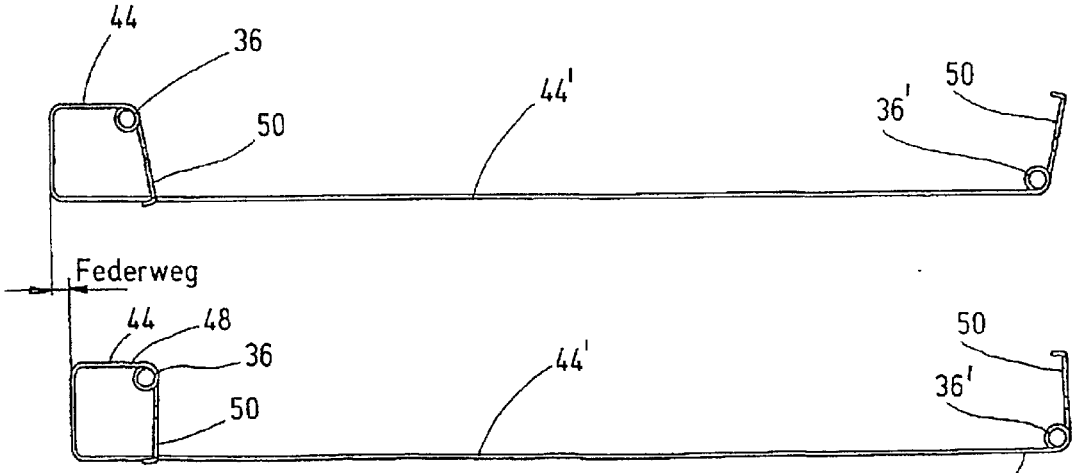
FIG. 6*c* a top view upon the tension member with integrated spring according to FIG. 5*a* in open position and in closed position for illustration of the spring path.
Figure 10C:
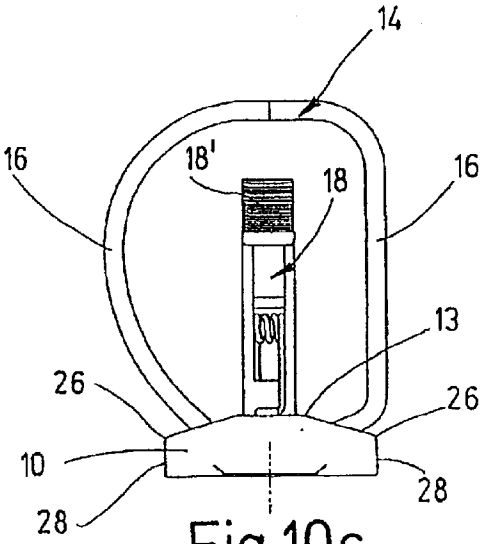
FIGS. 10*a–c* a side view, a top view and an end view of the lever operation of the ring binder mechanism with two rings.
Figure 10A:
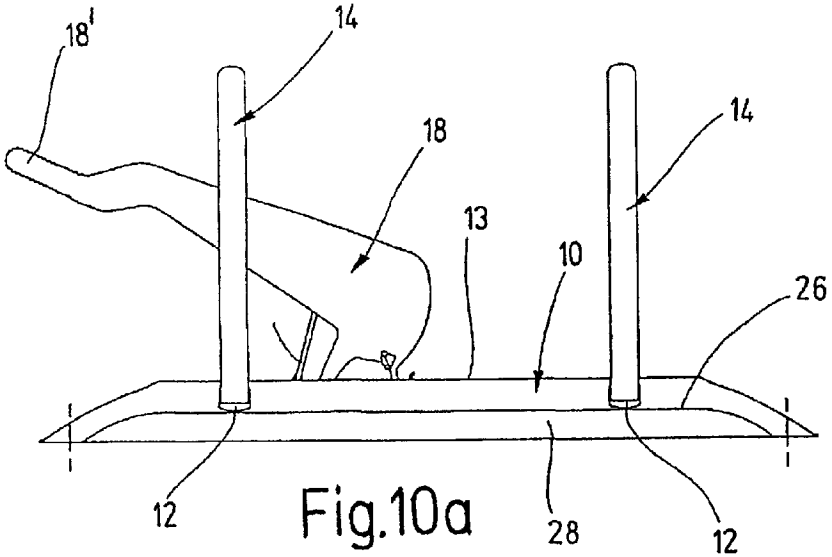
Figure 10B:
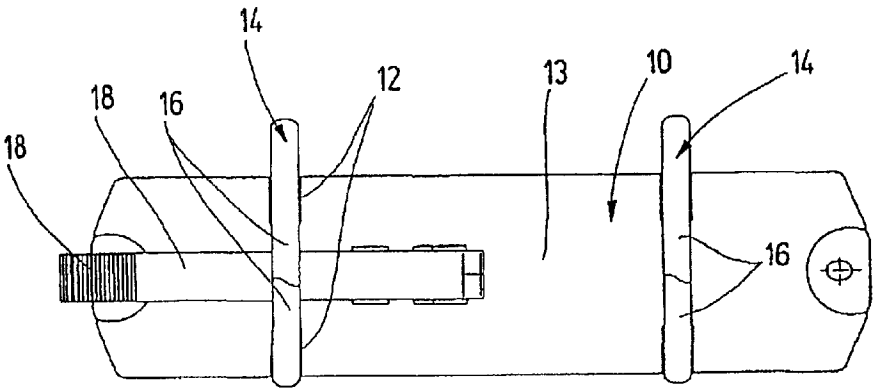
Figure 11C:
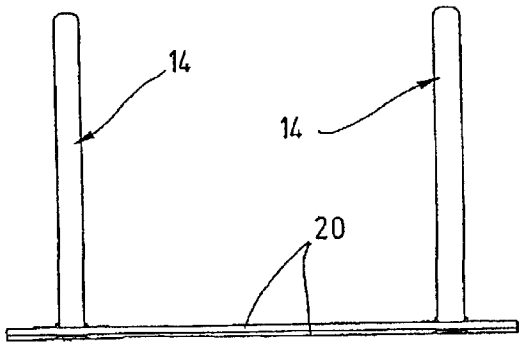
FIGS. 11*a–d* the rings with carrier rails of the ring binder mechanism according to FIGS. 10*a* through *c* in perspective representation, in an end view, a side view and a top view.
Figure 11A:
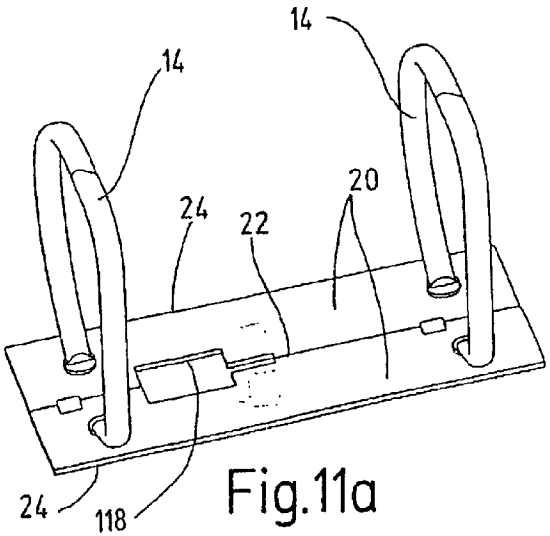
Figure 11B:
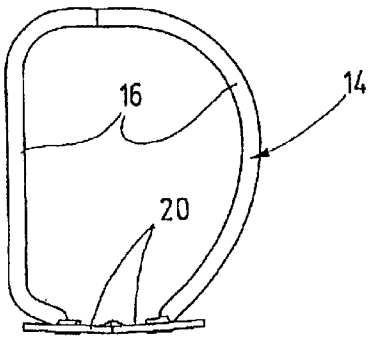
Figure 11D:
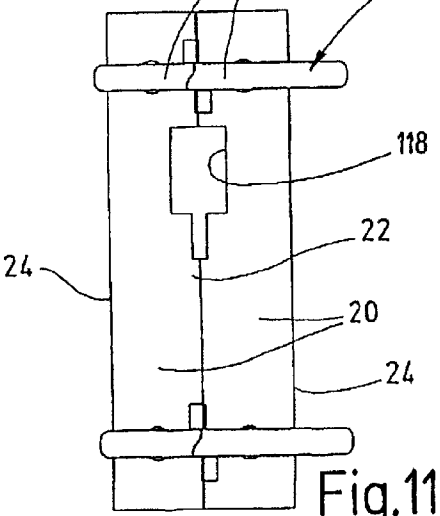

The binder ring mechanisms represented in the drawings are above all intended for receiving loose-leaf, holed sheets, for example writing material or printed products. The binder ring mechanism is comprised essentially of a housing, at least two half-rings 16 provided longitudinally spaced from each other and extending through openings 12 in the housing wall 13 and, with complementary half-rings, pairwise forming a ring 14, as well as an operating lever 18 for opening and closing the rings. The half-rings 16, which pairwise form rings 14, are rigidly secured to two carrier rails 20, which on their inward edges—the longitudinal edges facing each other—lie against each other thereby forming a linkage axis 22, and which with their outer edges—the longitudinal edges 24 facing away from each other—engage in mounting grooves 26 which face inward—facing each other—and which are stamped into the housing flanks 28. The carrier rails 20 are introduced into the housing in such a manner, that they can assume two rest positions, one open and one closed (FIGS. 3*c* and *d*). The housing functions as a spring element, which retains the half-rings 16 in their open position and in their closed position. In the area of the inner longitudinal edges 22 of the carrier rails 20 there are "take alongs" 30, which ensure that the two carrier rails 20 always lie with their longitudinal edges flush against each other. The carrier rails 20 thereby have the function of a knee-lever spring tensioned on the outer edges 24. Therewith the carrier rails 20 can be limitedly pivoted against each other about their linkage axis 22, taking along of the half-rings 16 between the open position and the closed position while utilizing the spring force produced by the bending apart of the housing flanks 28.

Figures 14A, 14B, 14C, 14D, 14E:
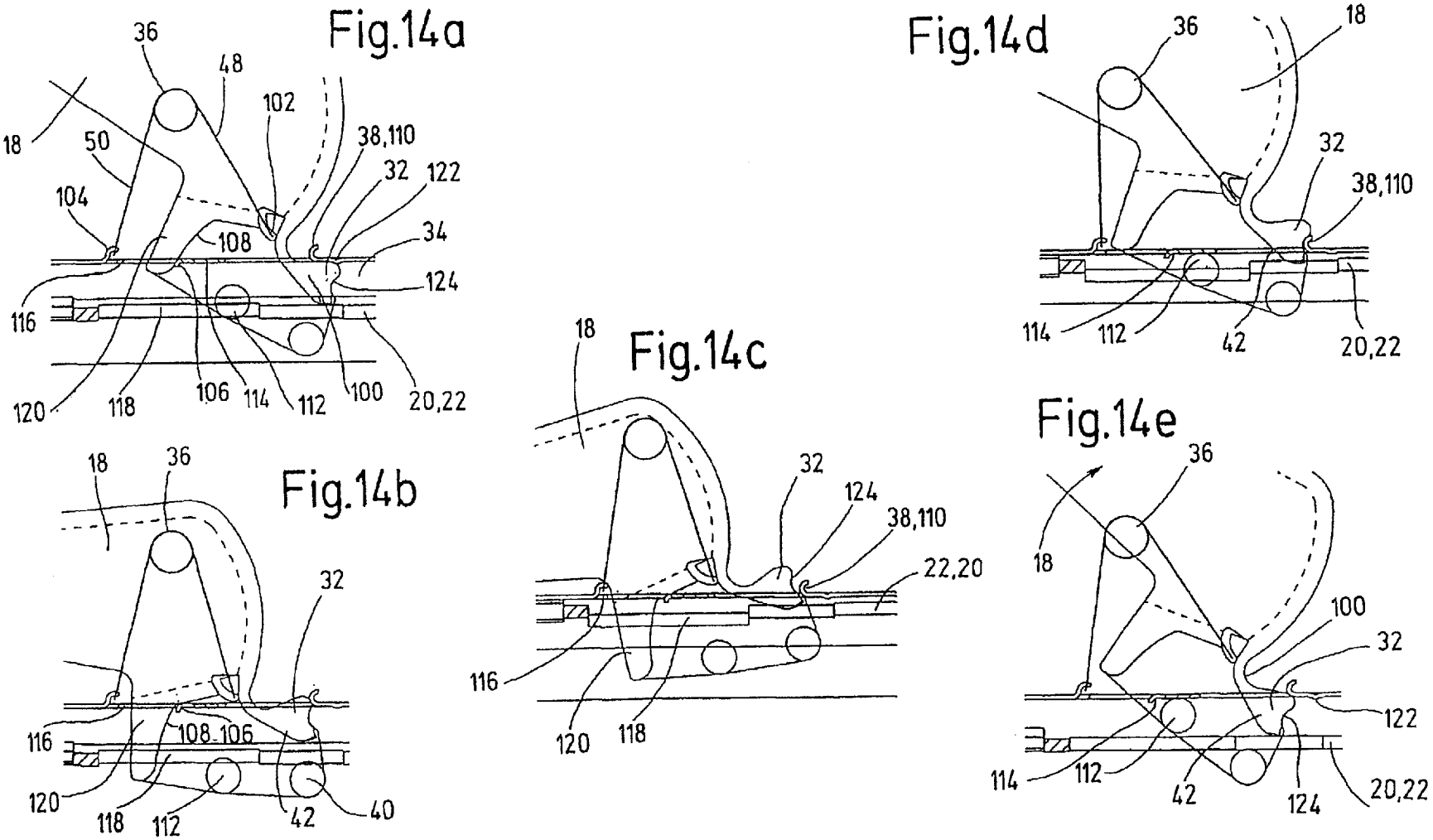
FIGS. 14*a–e* enlarged sections from FIGS. 13*a* through *e*.

In addition there is provided at least one slideable or moveable blocking element 32, 32', which via the operating lever 18 is slideable or moveable relative to the housing 10 essentially parallel to the linkage axis 22 and to the carrier rails 20, which when in the closed position engages in a free space 34 formed between the carrier rails 20 and the housing wall 13 with blockage of the pivot path of the carrier rails, and which when in the open position does not impede the pivot path about the linkage axis 22. A peculiarity of the shown construction is comprised therein, that at least one blocking element 32 is pre-tensioned, under the influence of at least one blocking spring 36, 36', in the direction of the locking position (FIGS. 6*a* through *c* and FIGS. 14*a* through *e*). The at least one blocking element 32, 32' is slideable or moveable into the open position via the operating lever 18 against the force of the blocking spring 36', 36', and thereby unlockable (FIGS. 8*a* and *c*; FIGS. 14*b* and *c*). In the open position the at least one blocking element 32, 32' lies under the influence of the blocking spring 36, 36' against an opening detent (FIG. 8*d*; FIG. 14*d*). From the open position the at least one blocking element 32, 32' can be released from the open detent 38 either via the operating lever 18 or else by pressing together of the half-rings 16 against the force of the blocking spring (FIG. 8*e*, FIG. 14*e*), so that it is pushed automatically into the free space 34 in the course of further closing under the influence of the pre-tensioned blocking spring 36, 36' and locks the carrier rails 20 in their closed position. The operating lever 18 further includes an opening arm or cantilever 40 which abuts against the carrier rails in the opening direction and pivots these from the closed into the open position while overcoming the spring force produced by the housing flanks 28. Further, the operating lever 18 is provided with a closing arm or cantilever 42 which abuts against the carrier rails 20 in the closed position and which pivots these from their open into the closed position while overcoming the spring force applied by the housing flanks 28. It is in principle possible, that the at least one blocking element 32, 32' is slideable or moveable against the force of the closing spring 36, 36' into the closed position also directly by operation of the half-rings 16, or indirectly via the carrier rails 20, and thereby is disengagable from the open detent 38.

In the embodiment of the ring binder mechanism shown in FIGS. 1 through 9 three rings 14 are provided equally distanced from each other as well as two blocking elements 32, 32', which are operable via an operating lever 18 provided at one end of the housing 10 outside of the areas intermediate the rings. The blocking elements 32, 32', which are provided in the area of the two outer rings, are connected with the operating lever 18 via a tension member 44, 44' and a closing spring 36, 36' integrated in the tension member. Each blocking element 32, 32' is thereby associated with one tension member 44, 44' and its own blocking spring 36, 36'. The tension members 44, 44' are pieces of wire, which are connected with each other as a single piece via a connecting bridge 46. The blocking springs 36, 36' integrated in the tension members 44, 44' are formed as leg springs, of which one of their legs 48 is connected with the operating lever via the respective tension member 44, 44' and of which their other leg 50 is supported against a mount 52 fixed to the carrier rail and is linked to an associated blocking element 32, 32' spaced apart from the support point. The blocking elements 32, 32' are in the form of sliding elements guided in a guide through-hole or slot 54 between the two carrier rails 20, which exhibits a wedge shaped locking surface 56 facing the locking direction and engaging in the free space 34 when in the locking position. The blocking elements further exhibit a leading edge 58 arrow shaped or pointed in the locking direction, while the guide through-hole on its bordering edge 38 facing the leading edge 58 exhibits a thereto complementary arrow shape.

Figure 1B:
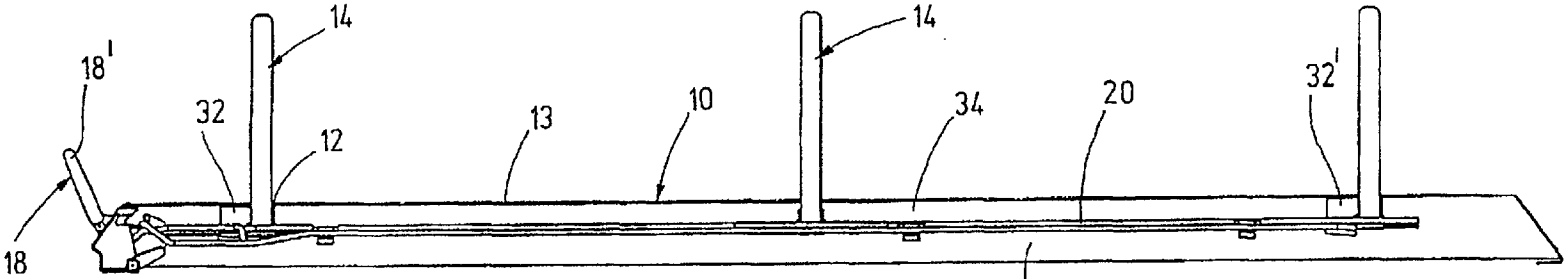
Figure 1A:
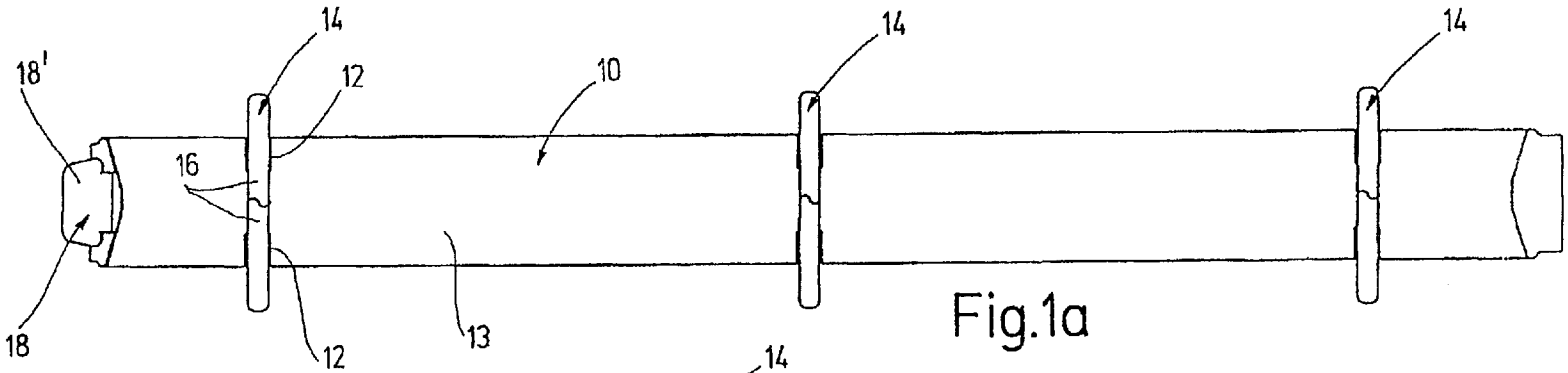
Figure 1C:
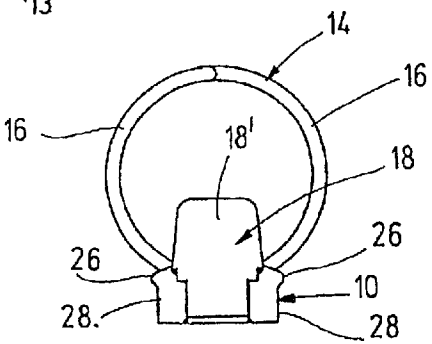
Figure 2D:
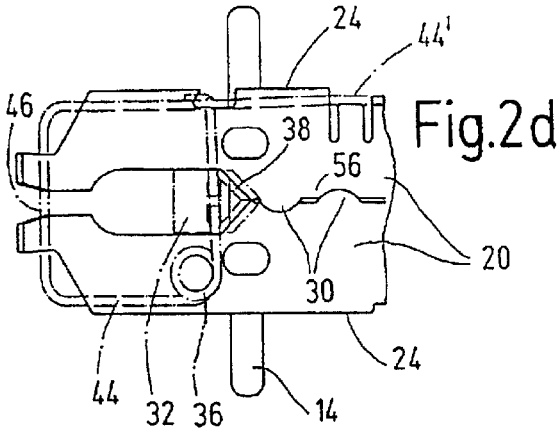
FIGS. 2*d* and *e* two enlarged sections of FIG. 2*a;*
Figure 2E:
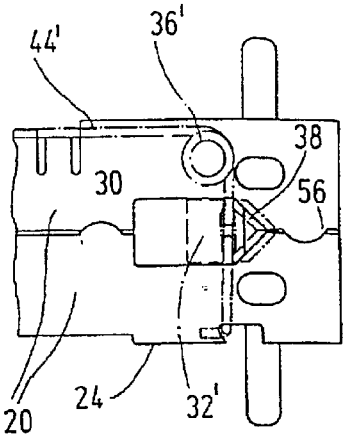
FIGS. 2*a–c* a bottom view, a side view and a top view of the rings of the ring binder mechanism connected with the carrier rails according to FIGS. 1*a–c;*
Figure 2A:
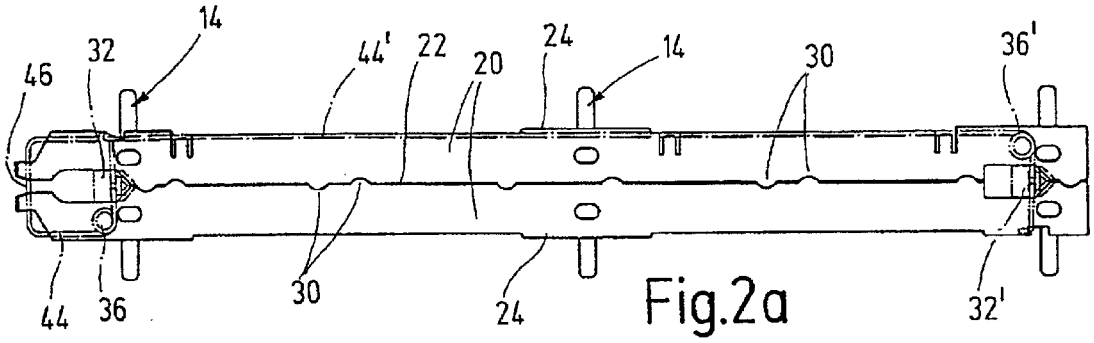
Figure 2B:
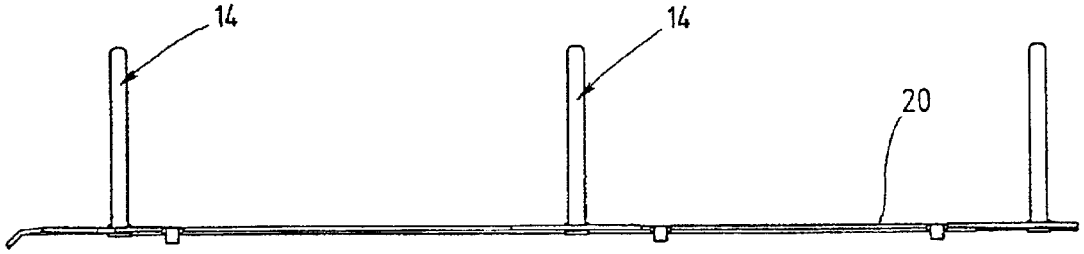
Figure 2C:
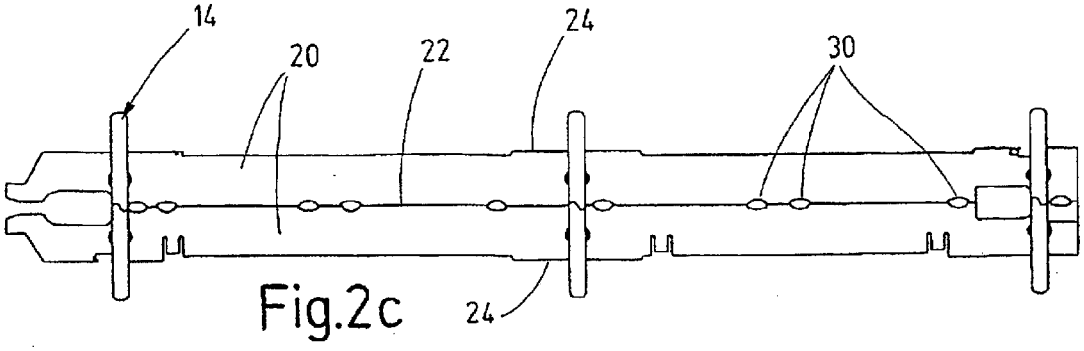

As can be seen particularly from FIGS. 5*a* through *e* taken with FIG. 1*b* and FIG. 8*a*, the operating lever 18 exhibits two pairs of mounting pins 70, 72 projecting outwardly sideways, which respectively lie against one housing-fixed mounting and guide surface 74, 76. The two mounting and guide surfaces 74, 76 form section-wise in the areas 74', 76' a detent 74', 76' for the corresponding mounting pins 70, 72. In the course of operation the mounting pins 70, 72 raise off from their mounting and guide surfaces 74, 76 (compare FIG. 8*c* for mounting pin 70 and FIGS. 8*d* and *e* for mounting pin 72). Further, the operating lever contains a hook element 78, in which the tension members 44, 44' are engaged or hung in via the connecting bridge 46 (see FIGS. 5*a* and 8*a* through *e*).

In the following the manner of operating of the relevant ring binder mechanism will be described on the basis of FIGS. 8*a* through *e* and 9*a* and *b:*

In FIG. 8*a* the closed position of the binder ring mechanism is shown, in which the lever arm 18' of the operating lever 18 is directed diagonally upwards, in which the mounting pins 70, 72 lie against the associated mounting and guide surfaces 74, 76, and in which the closing arm or cantilever 42 lies against the carrier rails 20. The linkage axis 22 of the carrier rails is pressed downwards within the housing 10, so that the abutment surfaces 80 of the half-rings 16 lie against each other to form a closed ring 14 (FIG. 9*a*). Further, the blocking elements 32, 32' protrude with their ends into the vacant space 34 and lie with their wedge-shaped blocking surface 56 against the inside facing surface of the carrier rails 20. Thereby the carrier rails 20, and the half-rings 16 secured to them, are blocked in their closed position. The pre-tensioning in the area of the closing springs 36, 36' ensures that, between the blocking elements 32, 32' on the one hand, and the adjacent abutment surfaces in the area of the housing wall 13 and the carrier rails 20 on the other hand, there results a forced engagement which is free of play. The wedge-shaped blocking surface 56 is self-jamming, so that an opening of the half-rings 16 by themselves is not possible.

In FIGS. 8*b* and *c* the opening phase is shown, in which the operating lever 18 is pressed down in the direction of the opening arrow 82. Therein first via the hook element 78 and the tension members 44, 44' the blocking elements 32, 32' are pulled out of their blocking position along the guide slot 54 in the direction of the operating lever 18 against the force of the blocking springs 36, 36', so that the carrier rails 20 are free to pivot about their linkage axis 22 (FIG. 8*b*). As pressing down is continued, the opening arm 40 pushes from below against the carrier rails 20 and presses these upwards while overcoming the spring force produced by the housing flanks 28, until the carrier rails 20 abut against the housing wall 13 (FIG. 8*c*). Thereby the half-rings 16 are pivoted into their open position (FIG. 9*b*).

After releasing the lever, this is return-pivoted somewhat automatically under the influence of the closing springs 36, 36', until the mounting pins 70 are seated in their detent 74' and the mounting pins 72 are lifted out of their detent 76' (FIG. 8*d*).

In the closing process the operating lever 18 is pressed upwards in the direction of the closing arrow 84. Therein the lever is first pivoted about the mounting pivot pin defined by the detent 74' under the influence of the closing springs 36', 36' and with its opening arm 74 is moved from above against the carrier rails 20 (FIG. 8*e*). Thereby the carrier rails 20 are pivoted downwards about their pivot axis 22 while overcoming the spring force produced by the housing flanks 28, past the blocking elements 32, 32', until the free space 32 becomes free. In the last phase of the locking movement the blocking elements 32, 32' are pushed under the influence of the closing springs 36, 36' automatically into their locking position, meanwhile taking along the operating lever 18 (FIG. 8*a*).

It is fundamentally possible to use, in place of the tension members 44, 44' with integrated blocking springs 36, 36', a not shown pull rod, which carries at least one rigidly connected blocking element 32 and which on its one end is hung into the hook element 78 of the operating lever 18 and on its other end exhibits an abutment for the closing spring formed as a compression spring which acts in the same direction as the closing springs 36, 36' of the embodiment shown in FIGS. 8*a* through *e*. In the case of using multiple blocking elements there occurs with this embodiment a tolerance problem, which is compensated in the embodiment shown in FIGS. 8*a* through *e* by the closing springs 36, 36' associated with the blocking elements 32, 32'.

In FIGS. 10 through 14 a further, alternative embodiment of the binder ring mechanism is shown, which is constructed as follows:

The ring binder mechanism includes two half-ring pairs 16 extending through openings 12 in the housing wall 13 and provided a defined separation from each other, which are not mirror symmetric and which together produce unround rings 14. This ring binder mechanism replaces the otherwise conventional lever mechanism of a letter file. In accordance therewith, an operating lever is employed for opening and closing the rings 14, which lever is provided in the intermediate area between the two rings, of which the operating arm 18' extends through the loop of one of the rings 14. A particularity of this embodiment is comprised therein, that the blocking element 32 is provided on a lever arm 100 rigidly connected with the operating lever 18 and that the operating lever 18 together with the blocking element 32 is limitedly displaceable or moveable relative to the housing 10 and the carrier rails 20. The lever arm 100 of the blocking element extends through a wall opening 116 of the housing, while the housing-fixed detent 110 is formed by a preferably curved border edge of the wall opening. The blocking spring 36, formed as a leg spring in the shown embodiment, is mounted under tension with one leg 48 against one lever-fixed abutment 102 and with its other leg 50 against a housing-fixed abutment 104. The operating lever includes a control curve 108 which is guided on a control edge 106 of the housing 10, over which the operating lever 18 and its blocking element 32 are slideable or moveable during pivoting from a closed position in the direction of the open position against the force of the closing spring 36 (see FIGS. 14*a* and *b*). The control curve 108 is provided on a control arm 120 extending through the wall opening 116 of the housing 10 and through hole 118 in the abutment area between the carrier rails 20, while the control edge 106 is preferably formed by a curved boundary edge of the wall opening 116. Further, in this case also the operating lever 18 is connected rigidly with an opening arm 40 acting in the opening direction against the carrier rails, which opening arm in this case is formed by two pins projecting towards opposite sides. The opening arm 40 is provided such a distance from the blocking element 32, that in the closed position of the operating lever 18 the blocking element is introducible into the free space 34 between the carrier rails 20 and the housing wall 13 and the under the influence of the closing spring 36, and in the open position abuts, under the influence of the closing spring 36, against a housing-fixed detent 110. The blocking element 32 or the lever arm 100 thereof is, in this case, at the same time also formed as a closing arm 42, acting in the closing direction against the carrier rails 20. In the closed position the blocking element 32 lies against a housing-fixed end abutment 122, which is wedge-shaped in the direction of closing and is formed by a bowing of the housing wall 13 projecting into the free space 32.

The operating lever further includes two pivot pin elements 112 formed as mounting pins and projecting towards opposite sides which, in the open position of the operating lever 32, lie against a housing-fixed mounting surface 114 under the influence of the closing spring 36 and form a rotation pivot pin for the blocking element 32 during the disengagement and closing movement and which, in the closed position of the operating lever 32, are lifted from the housing fixed mounting surface 114.

Figure 12B:
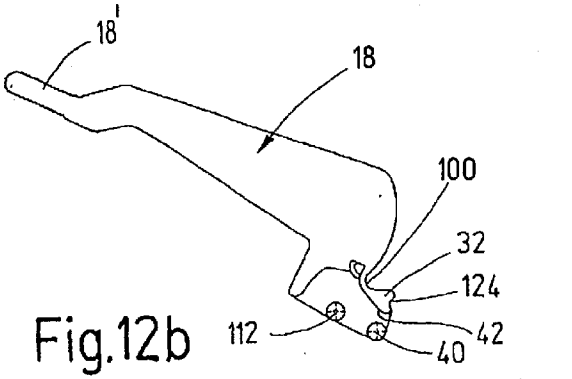
FIGS. 12*a–c* the operating lever of the ring binder mechanism according to FIGS. 10*a* through *c* in perspective representation, a side view and a top view.
Figure 12C:
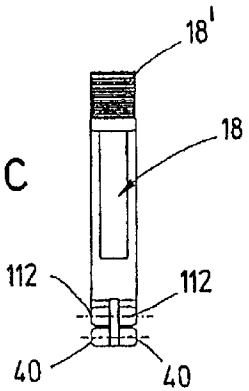
Figure 12A:
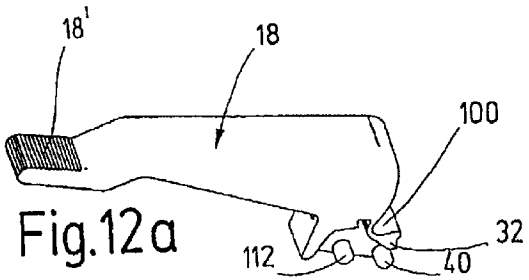

As can be seen from FIGS. 12*a* and *b*, in the shown embodiment the operating arm 18' of the operating lever 18 projects from the side opposite the blocking mechanism 32 carrying lever arm 100. In this case the mechanism is opened by pressing down the operating arm 18' and closed by raising the operating arm. Alternatively thereto, it is possible that the operating arm is directed towards the same side as the lever arm carrying the blocking element. In this case the mechanism is closed by pressing down of the operating arm and opened by raising.

In the following the manner of functioning of the above described ring binder mechanism will be described in greater detail on the basis of FIGS. 13*a* through *f* and 14*a* through *e:*

Figure 13D:
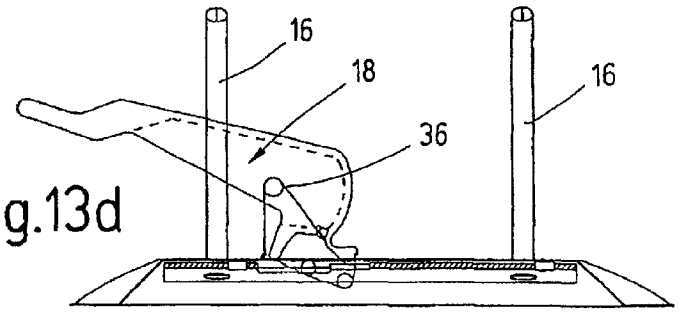
FIGS. 13*a–e* a partial sectional side view of the ring binder mechanism according to FIGS. 10*a* through *c* in various operating positions.
Figure 13E:
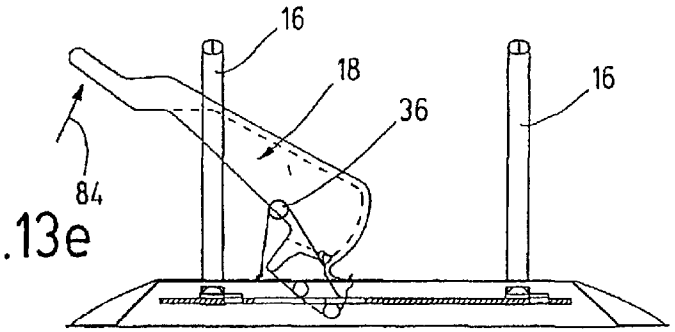

In the closed position of the rings 14 the blocking element 32 engages in the free space 34 between the carrier rails 20 and the housing wall 13. The pivot pin element 112 is lifted from the mounting surface 114 and the operating lever 18 abuts with its lever arm 100 in the area of the blocking element 32 against an end abutment 122, whereby the operating arm 18' projects diagonally upwards through the loop of the half ring pair 16 (FIGS. 13*a*, 14*a*).

The opening of the mechanism occurs in two phases: First during pressing down of the lever arm 18' in the direction of the arrow 82 the operating lever 18 is so pushed via the control curve 108 supporting itself on the control edge 106 against the force of the closing spring 36, that the blocking element 32 leaves the free space 34 (FIGS. 13*b*, 14*b*). During further pressing down the lever arm 100 is pivoted about the rotation pivot pin formed by the control edge 106. Thereby the opening arm 40 abuts from below against the carrier rails 20 and takes these upwards with it while overcoming the spring force produced by the housing sides 28 and while at the same time opening up the half-rings 16 (FIGS. 13*c* and 14*c*). Then the lever 18 is released, the blocking element 32 enters with its end side detent recess 124 under the influence of the closing spring 36 to the housing fixed detent 110. At the same time the lever arm 18' is pivoted upwards, until the pivot pin element 112 abuts against the abutment surface 114 (FIG. 14*d*). In this position the operating lever 18 assumes a stable open position.

For closing the mechanism the lever arm 18' is first pulled upwards in the direction of the arrow 84. Thereby the axis defined by the pivot pin element 112 is pivoted out of the housing fixed detent 110, with release of the blocking element 32. At the same time the carrier rails 20 are pressed downwards via a closing arm 42 with overcoming the spring force produced by the housing side flanks 28 with closing of the half-rings 16. The void space 34 becomes free, so that the blocking element 32 can enter into it under the influence of the closing spring 36 (FIGS. 13*e*, 14*e*). At the same time the operating lever assumes its closed position as shown in FIGS. 13*a*, 14*a*.

Figure 13F:
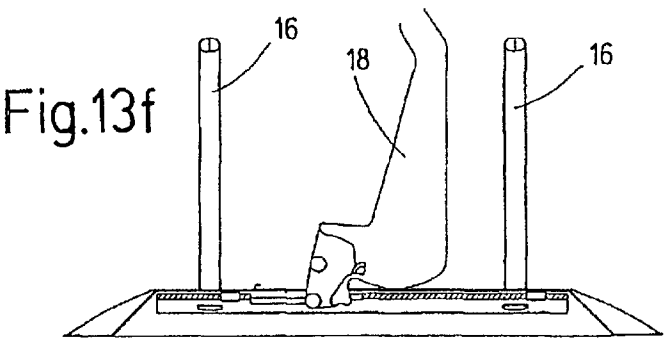
FIG. 13*f* a representation according to FIGS. 13*a* through *e* with the operating lever in assembling position.
Figure 13A:
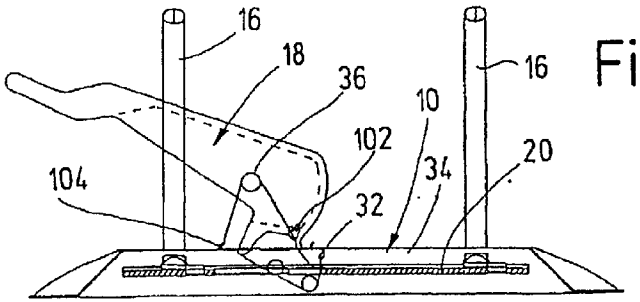
Figure 13B:
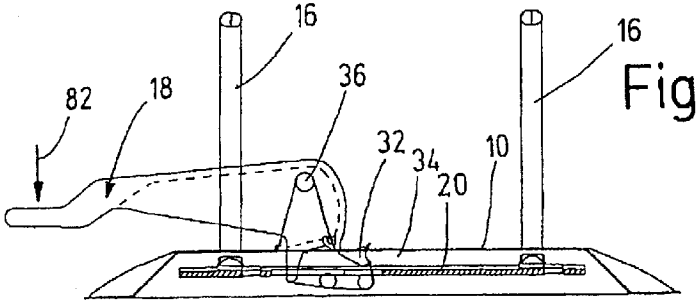
Figure 13C:
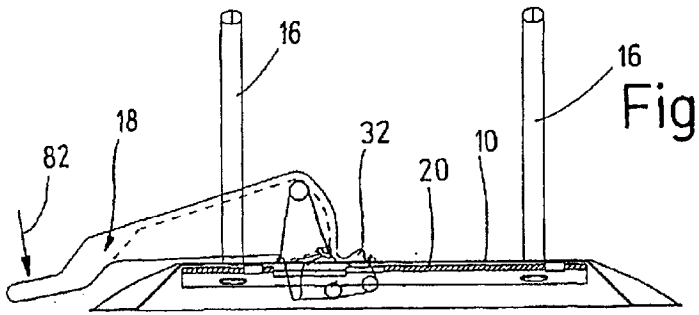

In FIG. 13*f* the position in which the operating lever 18 can be introduced during the assembly of the housing 10 is shown.

In summary the following can be concluded: The invention concerns a ring binder mechanism for receiving of loose written materials. The ring binder mechanism includes a housing 10 with spring-elastic bendable housing flanks 28. In the housing are two carrier rails 20, which are pivotable with respect to each other in the manner of a knee-lever in the area of their facing or contacting longitudinal edges under the spring effect of the housing flanks 28. At least two longitudinally spaced-apart half-rings 16, which with complementary half-rings pairwise form a ring 14, are rigidly connected with the carrier rails 20. Further, at least one blocking element 32 slideable or moveable relative to the housing 10 via an operating mechanism 18 essentially parallel to the linkage axis 22 and to the carrier rails 20, which in the closed position protrudes into a free space 34 formed between the carrier rails 20 and the housing wall 13 with blocking of the pivot movement of the carrier rails 20, and which in the open position frees the pivot path about the linkage axis 22. It is proposed in accordance with the invention, that the at least one blocking element 32 is pre-tensioned in the direction of the closed position under the influence of a closing spring 36.

What is claimed is:

1. A ring binder mechanism comprising:

a housing (10) having a C- or U-shaped cross-section with spring-elastic bendable flanks (28) for receiving two carrier rails (20), wherein said carrier rails, on their facing longitudinal edges, lie against each other forming a linkage axis (22) and, with their away-facing longitudinal edges (24) engage in mounting grooves (26) in the housing flanks (28), and at least two half-rings (16) longitudinally spaced apart and rigidly connected with each of the carrier rails (20), wherein said half-rings (16) extend through openings (12) in a housing wall (13) and together form a ring (14), wherein the carrier rails (20) are limitedly pivotable against each other about the linkage axis (22) between an open position and a closed position upon overcoming a spring force along the half-rings (16) produced by the housing flanks (28), wherein at least one blocking element (32, 32') is slideable or moveable via operating element (18), wherein said at least one blocking element (32, 32') is essentially parallel to the linkage axis (22), wherein said at least one blocking element (32, 32') is slideable or moveable relative to the housing (10) and to the carrier rails (20), wherein when said at least one blocking element (32, 32') is in the closed position, it protrudes into a free space (34) formed between the carrier rails (20) and the housing wall (13) and the pivot movement of the carrier rails (20) is blocked, and wherein when said at least one blocking element (32, 32') is in the open position, the carrier rails (20) may pivot about the linkage axis (22), and wherein at least one blocking element (32, 32') is pre-tensioned in the direction of the closed position under the influence of a closing spring (36, 36').

2. The ring binder mechanism according to claim 1, wherein the operating element (18) is a lever pivotable with respect to the housing (10).

3. The ring binder mechanism according to claim 1, wherein the at least one blocking element (32, 32') is slideable or moveable in the open direction via the operating element (18) against the force of the closing spring (36, 36'), and wherein the at least one blocking element (32, 32') is thereby unlockable.

4. The ring binder mechanism according to claim 1, wherein the at least one blocking element (32, 32'), when in the open position, lies against an opening detent (38, 110) under the influence of the closing spring (36, 36').

5. The ring binder mechanism according to claim 4, wherein the at least one blocking element (32, 32') is releaseable, in the closing direction, via the operating element (18) out of the opening detent (38, 110) against the force of the closing spring (36, 36').

6. The ring binder mechanism according to claim 5, wherein the at least one blocking element (32, 32') is automatically lockable in the closed direction under the influence of the pre-tensioned closing spring (36, 36').

7. The ring binder mechanism according to claim 2, wherein the operating element (18) includes an opening arm (40) abutting against the carrier rails (20) in the open position and which pivots said carrier rails (20) from the closed position into the open position while overcoming the spring force produced by the housing flanks (28).

8. The ring binder mechanism according to claim 2, wherein the operating element (18) includes a closing arm (42) abutting against the carrier rails (20) in the closing direction and which pivots said carrier rails (20) from the open position into the closed position while overcoming the spring force produced by the housing flanks (28).

9. The ring binder mechanism according to claim 1, wherein the at least one blocking element (32, 32') is slideable or moveable in the closing direction against the force of the closing springs (36, 36'), and thereby releasable out of the opening detent (38, 110), directly by operation of the half-rings (16) , or indirectly via the carrier rails (20).

10. The ring binder mechanism according to claim 2, wherein the operating element (18) in the open and/or closed direction exhibits at least two operating positions effective in different angular positions for a consequential operation of the at least one blocking element (32, 32') and the carrier rails (20).

11. The ring binder mechanism according to one of claim 2, wherein the blocking element (32) is provided on a lever arm (100) rigidly connected with the operating element (18), and wherein the operating element (18) is limitedly pivotable relative to the housing (10) and to the carrier rails (20) in the sliding direction of the blocking element (32).

12. The ring binder mechanism according to claim 11, wherein the blocking spring (36) is tensioned in between a housing fixed abutment and an operating lever fixed abutment (104, 102).

13. The ring binder mechanism according to claim 12, wherein the blocking spring (36) is a shank spring.

14. The ring binder mechanism according to claim 11, wherein the operating element (18) includes a control curve (108) guided on one control edge (106) of the housing (10), and wherein the operating element (18) and the blocking element (32), during pivoting against the force of the closing spring (36), are slideable or moveable from a closing position in the direction of the open position.

15. The ring binder mechanism according to claim 14, wherein the operating element (18) is rigidly connected with an opening arm (40) acting, in the opening direction, against the carrier rails.

16. The ring binder mechanism according to claim 15, wherein the opening arm (40) is separated from the blocking element (32) such that the blocking element (32), in the closed position of the operating element (18) and the carrier rails (20), is insertable in the free space (34) between the carrier rails (20) and the housing wall (13) under the influence of the closing spring (36), and, in the open position, abuts against a housing-fixed detent (110) under the influence of the closing spring (36).

17. The ring binder mechanism according to claim 16, wherein the blocking element (32) is simultaneously a closing arm (42) acting in the closing direction against the carrier rails (20).

18. The ring binder mechanism according to claim 11, wherein the operating element (18) includes at least one pivot pin element (112) that lies in the open position of the operating element (18) against a housing fixed mounting surface (114) under the influence of the closing spring (36) and forms a pivot axis for the blocking element (32) during the disengagement or unblocking and closing movement.

19. The ring binder mechanism according to claim 18, wherein the pivot pin element (112), in the closed position of the operating element (18), is raised from the housing-fixed mounting surface (114).

20. The ring binder mechanism according to claim 11, wherein the control curve (108) is provided on a control arm (120) extending through a wall opening (116) of the housing (10) and through a through-hole (118) in the linkage axis (22) area between the carrier rails (20).

21. The ring binder mechanism according to claim 20, wherein the control edge (106) is formed by a preferably curved border edge of the wall opening (116).

22. The ring binder mechanism according to claim 11, wherein the blocking element (32) is provided on a lever arm (100) extending through a wall opening (116) in the housing.

23. The ring binder mechanism according to claim 22, wherein the housing fixed detent (110) is formed by a preferably curved border edge of the wall opening (116).

24. The ring binder mechanism according to claim 11, wherein the blocking element (32) abuts in the closed direction, under the influence of the closing spring (36), against a housing-fixed end-stop (122).

25. The ring binder mechanism according to claim 24, wherein the end abutment (122) is wedge-shaped in the closing direction.

26. The ring binder mechanism according to claim 24, wherein the end abutment (122) is formed by a bowing out of the housing wall (13) protruding into the free space (34).

27. The ring binder mechanism according to claim 11, wherein the operating element (18) is mounted and guided on the housing (10) in the intermediate area between the rings (14), and includes an operating arm (l8') extending through a loop of one of the rings (14).

28. The ring binder mechanism according to claim 27, wherein the operating arm (18') is directed away from the lever arm (100) carrying the blocking element (32).

29. The ring binder mechanism according to claim 27, wherein the operating arm (18') faces the same side as the blocking element (32) carrying lever arm (100).

30. The ring binder mechanism according to claim 2, wherein the at least one blocking element is rigidly provided on a control rod, preferably formed as a pull rod, such that the operating element (18), under the influence of the closing spring, is limitedly slideable or moveable in the longitudinal direction of the carrier rails (20) relative to the housing (10).

31. The ring binder mechanism according to claim 30, wherein the closing spring is a pressure spring.

32. The ring binder mechanism according to claim 31, wherein the operating element (18) is provided at one end of the control rod and wherein the closing spring is tensioned in between the other end of the control rod and a housing fixed abutment.

33. The ring binder mechanism according to claim 32, wherein the operating element (18) pulls against the control rod in the open position against the pressure force of the closing spring.

34. The ring binder mechanism according to claim 30, wherein the operating element (18) is rigidly connected with an opening arm acting in the opening direction against the carrier rails.

35. The ring binder mechanism according to claim 30, wherein the operating element (18) is rigidly connected with a closing arm acting in the closing direction against the carrier rails.

36. The ring binder mechanism according to one of claims 2, wherein at least one blocking element (32, 32') is connected with the operating element (18) via a tensioning member (44, 44') and a closing spring (36, 36') integrated in the tension member.

37. The ring binder mechanism according to claim 36, wherein each blocking element (32, 32') is associated with the tension member (44, 44').

38. The ring binder mechanism according to claim 37, wherein at least two of the tension members (44, 44') are unitarily connected with each other, preferably via a connecting bridge (46).

39. The ring binder mechanism according to claim 36, wherein each blocking element (32, 32') is associated with a closing spring (36, 36').

40. The ring binder mechanism according to claim 36, wherein the tension member (44, 44') is a piece of wire.

41. The ring binder mechanism according to claim 36, wherein the closing spring (36, 36') is a shank spring integrated in the tension member (44, 44'), of which one leg (48) is connected with the operating element (18) and the other leg (50) is supported on a housing-fixed or carrier rail-fixed mount (52) and is fixed spaced apart from the support point on the associated blocking element (32, 32').

42. The ring binder mechanism according to claim 36, wherein the at least one blocking element (32, 32') is formed as a sliding element guided in a guide slot or through-hole (54) between the two carrier rails (20), which exhibits a wedge shaped closing surface (36) facing in the closing direction, which in the closed position engages in the free space (34).

43. The ring binder mechanism according to claim 42, wherein the sliding element exhibits a face (58) which is wedge or arrow-shaped in the closing direction, and that the guide through-hole (54), on its bordering edge (38) facing the end face (58), exhibits a thereto complimentary arrow shape.

44. The ring binder mechanism according to claim 36, wherein the operating element (18) is rigidly connected with an opening arm (40) which lies, when moved in the opening direction, against the carrier rails (20).

45. The ring binder mechanism according to claim 36, wherein the operating element (18) is rigidly connected with a closing arm (42) which lies, when moved in the closing direction, against the carrier rails (20).

* * * * *